US005415447A

United States Patent [19]

Moore et al.

[11] Patent Number: 5,415,447

[45] Date of Patent: May 16, 1995

[54] FOOD PRODUCT DISPENSER GRIP

[76] Inventors: Latesha N. Moore, 1232 First St., Rockville, Md. 20850; Jennifer L. Brown, 1707 Gruenther Ave., Rockville, Md. 20851; Jennifer A. Burtner, 14118 Flint Rock Rd., Rockville, Md. 20853; Nida S. Vargas, 616 Long Wood Dr., Rockville, Md. 20850

[21] Appl. No.: 265,769

[22] Filed: Jun. 27, 1994

[51] Int. Cl.[6] ..... A47J 45/07

[52] U.S. Cl. ..... 294/33; 294/25; 294/32

[58] Field of Search ..... 294/19.1, 25, 27.1, 294/31.2, 32, 33; 220/696, 737, 739, 743; 215/100 A; 222/142.1, 465.1

[56] References Cited

U.S. PATENT DOCUMENTS

| | | | |
|---|---|---|---|
| 1,341,756 | 6/1920 | Morine | 294/31.2 |
| 1,377,350 | 5/1921 | Hoskin | 294/33 |
| 1,965,638 | 7/1934 | Gerhardt | 294/19.1 X |
| 2,116,148 | 5/1938 | Hawley | 294/27.1 X |
| 2,755,977 | 7/1956 | Malcolm . | |
| 2,844,346 | 7/1958 | Six . | |
| 2,889,082 | 6/1959 | West | 222/465.1 X |
| 2,991,907 | 7/1961 | Kinnison | 294/31.2 X |
| 3,960,021 | 6/1976 | Jones | 294/19.1 X |
| 4,741,073 | 5/1983 | Capen . | |
| 4,889,376 | 12/1989 | Nagy . | |
| 4,898,297 | 2/1990 | Wheeler . | |
| 4,993,675 | 2/1991 | Walker . | |
| 5,054,638 | 10/1991 | Rose . | |

*Primary Examiner*—Dean Kramer
*Attorney, Agent, or Firm*—Baker & Botts

[57] ABSTRACT

The invention is a grip for holding a seasoning shaker. The grip is made from a strong and rigid material, such as steel or plastic. The grip includes a finger loop; a support ring surrounding the shaker; a rigid arm extending from the finger loop to the support ring; a retaining finger, whereby the shaker is retained within the support ring when dispensing seasoning; and a holding brace, which supports the shaker in a upright position and prevents the shaker from sliding out of the ring. Although the grip is made from a rigid material, the retaining finger is sufficiently flexible that it may be pushed aside to remove the shaker for cleaning or repair.

13 Claims, 4 Drawing Sheets

Fig. 1
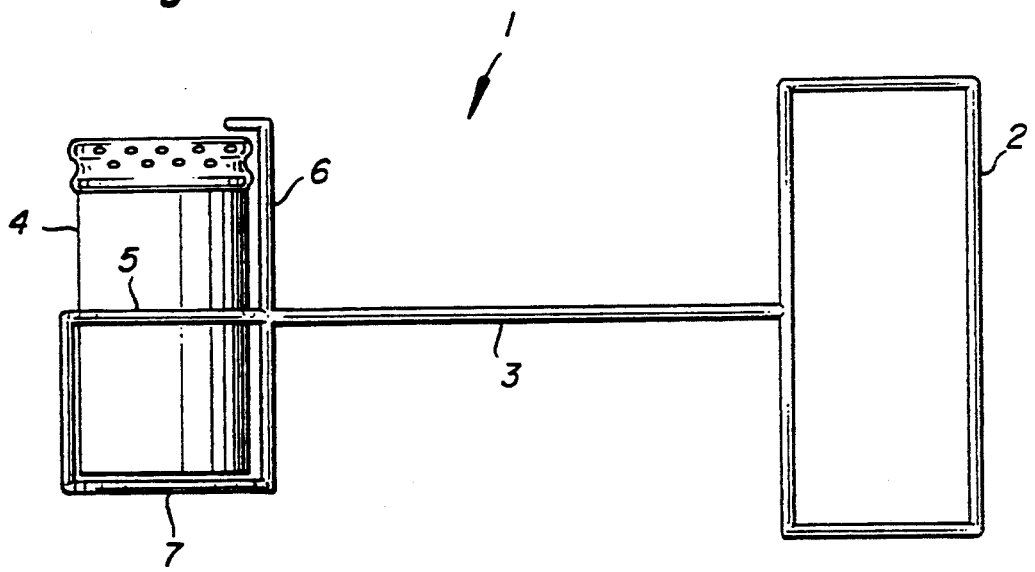
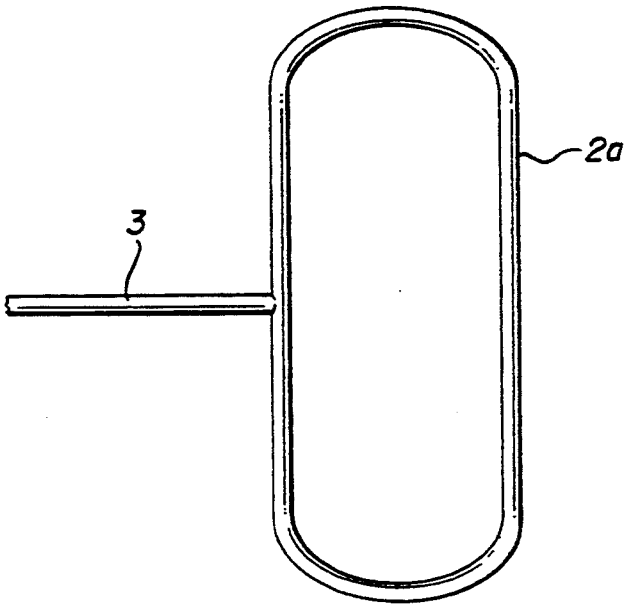
Fig. 2a
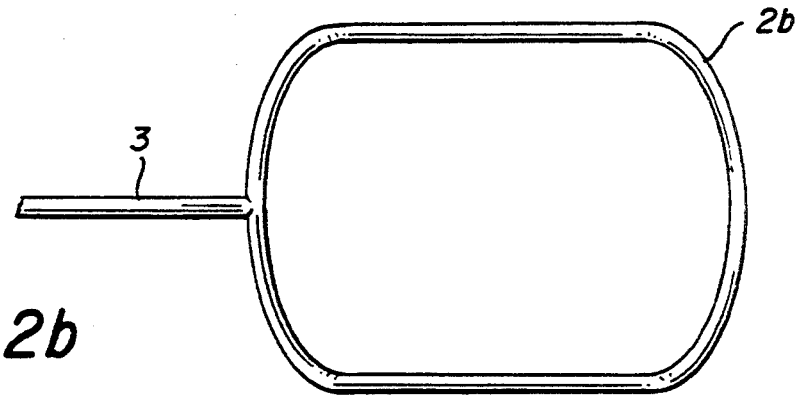
Fig. 2b

FOOD PRODUCT DISPENSER GRIP

FIELD OF THE INVENTION

The invention relates to prosthetic devices for use by persons suffering from temporary or permanent disabilities effecting the use of fingers or hands, such as persons suffering from arthritis, to hold food product dispensers, and in particular, it relates to grips for holding seasoning shakers.

BACKGROUND OF THE INVENTION

Persons with temporary or permanent physical disabilities face numerous challenges to their independence. These challenges are especially great when the disabilities involve the use of fingers and hands. Such disabilities may include, but are not limited to, deformation of hands or fingers and damage to hand or finger muscles, bones, tendons, or nerves.

The ability to prepare food and to feed oneself is important to maintaining independence. Food product dispensers include containers and shakers made from plastic, glass, reinforced paper, e.g., cardboard, or the like for holding and dispensing food products, such as sugar, desert or salad toppings, or seasonings. Seasonings may include salt or spices, such as pepper, oregano, or nutmeg, or combinations of seasonings. Food product dispensers have at least one dispensing opening to permit the food product to be dispensed, e.g., shaken, from the dispenser. Such dispensers may also be disposable or reusable. If reusable, the dispensers are generally equipped with a top fill opening, such as a removable lid, or a bottom fill opening.

Common food product dispenser designs generally do not allow persons with finger or hand disabilities to easily use such dispensers. Many seasoning shakers are too small or too smooth for persons suffering from arthritis or other physically disabling conditions or persons with broken fingers or hands to grasp and use. Because food product dispensers are widely used, dispensers are preferably simple to use and inexpensive to construct.

SUMMARY OF THE INVENTION

Thus, a need has arisen for a grip for holding food product dispensers, such as seasoning shakers, e.g., salt and pepper shakers, which permits greater independence for arthritic and persons suffering from permanent or temporary hand or finger disabilities. It is an advantage of this invention that the grip allows arthritic, physically handicapped, or persons with broken fingers or hands to use food product dispensers. It is another advantage of the invention that it is designed for simple and inexpensive construction. It is yet another advantage of the invention that because the food product dispensers are refillable, the grip is reusable.

The invention is a grip for holding a food product dispenser. The grip comprises a finger loop; a support ring surrounding the dispenser; a rigid arm extending from the finger loop to the support ring; a retaining finger, whereby the dispenser is retained within the support ring when dispensing food product; and a holding brace, which supports the dispenser in a upright position and prevents the dispenser from sliding out of the ring.

The invention possesses numerous technical advantages. For example, it is a technical advantage of the invention that the loop is adjustable or may be made in a plurality of different shapes and sizes. Further, it is a technical advantage of the invention that both top filling and bottom filling dispensers may be used with the grip. Moreover, it is a technical advantage that the flexible retaining finger permits the dispenser to be removed and cleaned or refilled and replaced. It is still another technical advantage that the bottom brace may hold the food product dispenser upright when the grip is set down. This prevents food product from spilling and orients the loop, so that fingers or a portion of a hand may be easily inserted.

Other objects, advantages, and features will be apparent when the detailed description of the invention and the drawings are considered.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which:

FIG. 1 depicts a profile view of a food product dispenser grip of the invention holding a seasoning shaker.

FIGS. *2a–2d* are partial, profile views of the grip of FIG. 1. FIGS. *2a* and *2b* depict alternative shapes and sizes of a finger loop for the grip of FIG. 1, and FIGS. *2c* and *2d* depict adjustable finger loops.

Figure 3:
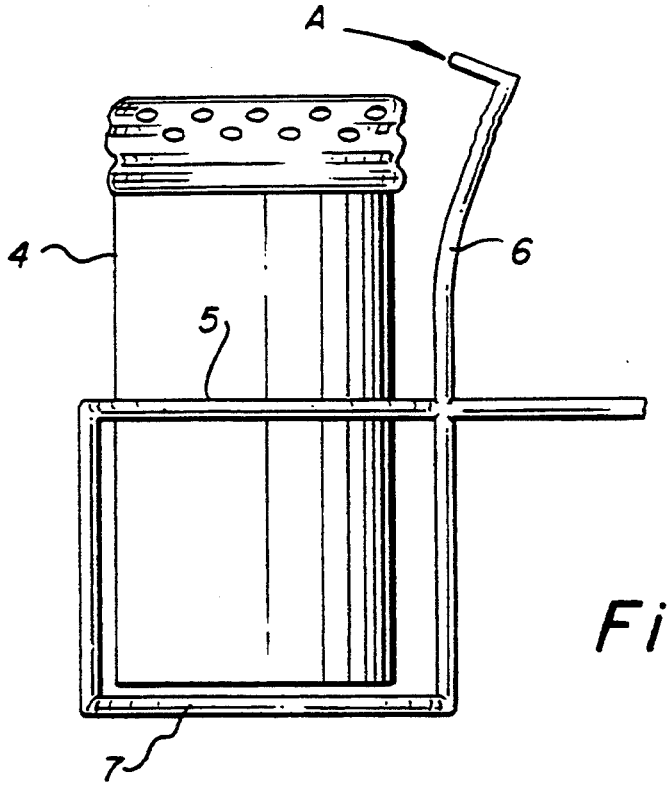

FIG. 3 depicts a partial, enlarged view of the grip of FIG. 1 showing a flexible retaining finger.

Figure 4:
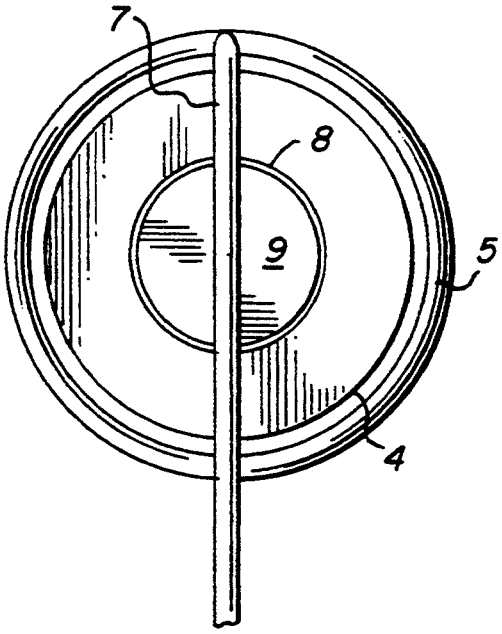

FIG. 4 depicts a partial, bottom view of the grip of FIG. 1 holding a shaker with a bottom fill opening.

Figure 5:
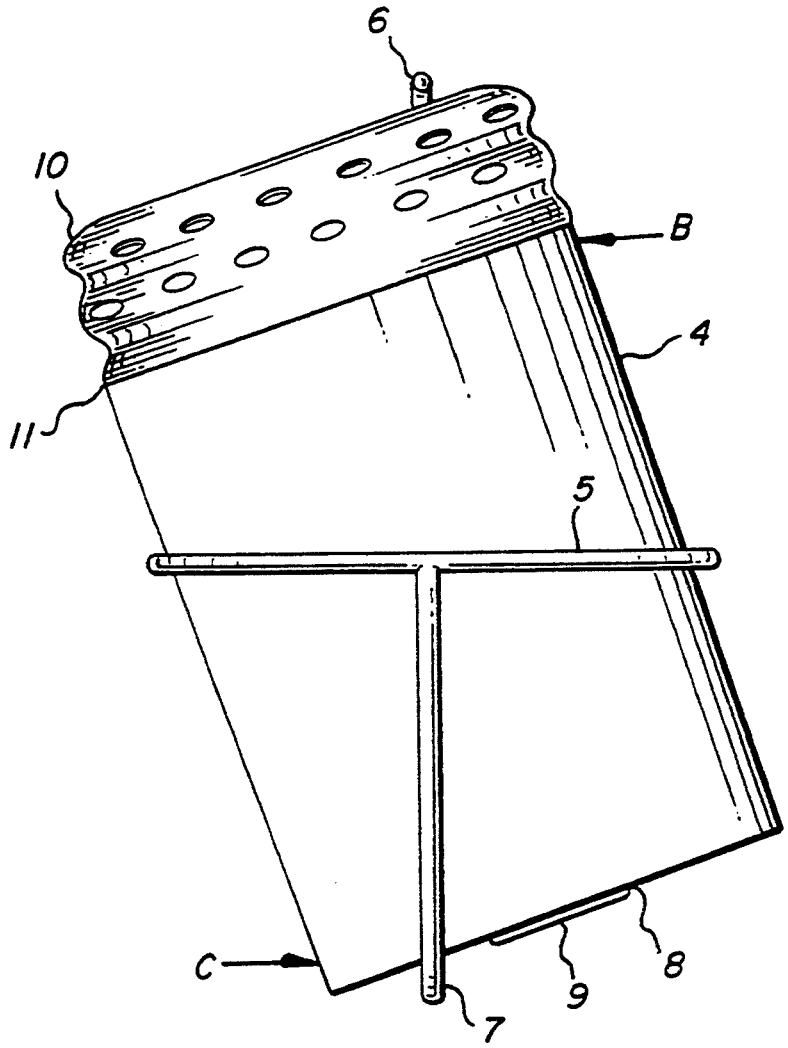

FIG. 5 depicts a frontal view of the grip of FIG. 1 showing the seasoning shaker pivoted to expose a bottom fill opening for filling and refilling.

DETAILED DESCRIPTION OF THE INVENTION

Referring to FIG. 1, a grip 1 includes a finger loop 2, which may come in different sizes or may be adjustable to accommodate different numbers of fingers or different hand or finger shapes. Grip 1 is made from materials which are strong and substantially rigid, such that grip 1 does not bend when a seasoning shaker 4 is inserted into grip 1. Suitable materials include plastics, wood, ceramic composites, and the like. Rigid metals, such as steel, are also suitable. However, flexible metals or thin strips of a soft metal, e.g., thin copper wire, may be insufficiently rigid to properly support the weight, e.g., in a range of about 2 to 8 ounces, of shaker 4. Nevertheless, multiple strands of wire, such as twisted coat hanger wire, is sufficiently rigid.

An arm 3 extends from a loop 2 and is sufficiently rigid to support seasoning shaker 4. A seasoning shaker support ring 5 surrounds shaker 4 and holds shaker 4 upright. A retaining finger 6 prevents shaker 4 from sliding out of ring 5, but does not interfere with seasoning dispensing from shaker 4. A holding brace 7 surrounds the bottom of shaker 4 and prevents it from sliding out of ring 5.

Finger loop 2 may be adjustable by various methods to permit grip 1 to be operated with various numbers of fingers or by persons with various finger or hand shapes and sizes. Further, finger loop 2 may be adjusted to accommodate changes in a user's finger or hand shape and size caused by the progression of a disabling disease, such as arthritis. Adjusting the size and shape of finger loop 2 may include deforming the finger loop of a metal grip or heating and deforming the finger loop of a plastic, e.g., a thermoplastic, grip to more closely conform to the user's finger(s) or hand. Referring to FIGS. 2*a* and 2*b*, for example, grip 1 may also be manufactured with finger loops 2*a* and 2*b* of various shapes and sizes.

Figure 2C:
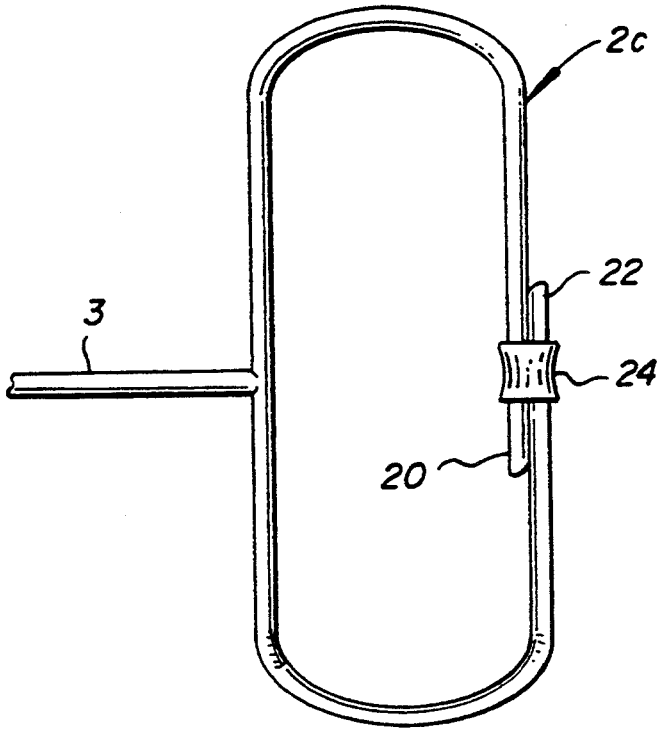
Figure 2D:
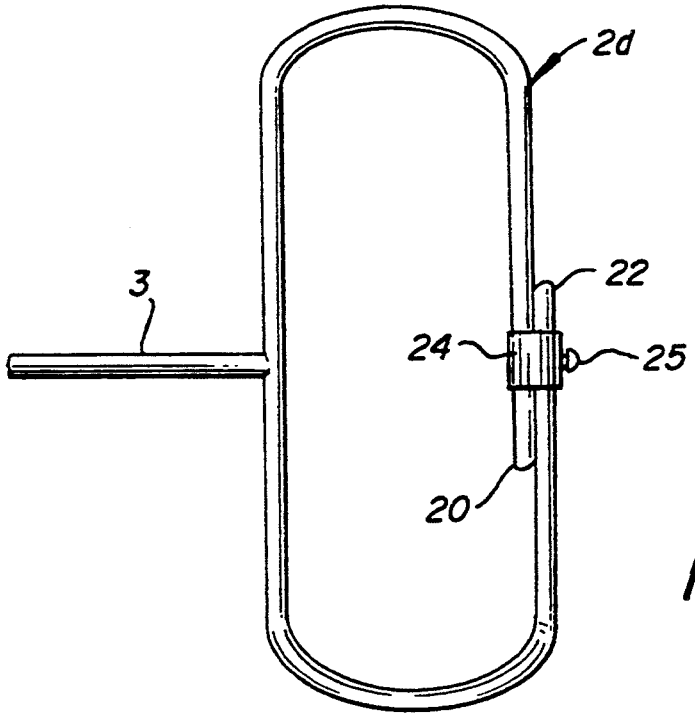

In yet another embodiment depicted in FIG. 2*c*, finger loop 2*c* has an upper end 20 and a lower end 22 which are slidably disposed within a crimping band 24. The shape and size of loop 2*c* is adjusted by slidably adjusting the relative positions of ends 20 and 22 within crimping band 24 and crushing crimping band 24 to fix the relative positions of ends 20 and 22 and, thereby, the shape and size of loop 2*c*. FIG. 2*d* shows still another embodiment of crimping band 24 equipped with a crimping bolt 25 which, when tightened, also fixes the relative positions of ends 20 and 22.

As mentioned above, grip 1 is made from a material that is sufficiently rigid to support a full seasoning shaker, such as twisted metal wire. Referring to FIG. 3, retaining finger 6 is sufficiently flexible, however, such that it may be pushed aside in the direction of arrow A to remove shaker 4. Further, ring 5, finger 6, and brace 7 surround shaker 4 loosely, such that shaker 4 may be pivoted to permit shaker 4 to be filled from the top or the bottom. Referring to FIG. 4, a partial bottom view of grip 1 is shown. Shaker 4 is equipped with a bottom fill opening 8 and a bottom fill opening cap 9. The size and shape of fill opening 8 and cap 9 permit shaker 4 to be pivoted to allow removal of cap 9 and the filling of shaker 4 with seasoning. FIG. 5 depicts shaker 4 pivoted within ring 5, finger 6, and brace 7. Sufficient force may be applied to the upper portion of shaker 4 in the direction of arrow B and to the lower portion of shaker 4 in the direction of arrow C to pivot shaker 4 and expose fill opening 8 and cap 9. Alternatively, if shaker 4 is pivoted sufficiently or finger 6 is pushed aside sufficiently, or both, to permit removal of lid 10, shaker 4 may be filled through top fill opening 11.

Nevertheless, ring 5, finger 6, and brace 7 are sufficiently tight-fitting that shaker 4 is retained within grip 1 when seasoning is dispensed and shaker 4 sits upright when grip 1 is set down on a flat surface. This prevents shaker 4 from overturning and seasoning from spilling and orients finger loop 2, so that a user's fingers or hand may be easily inserted.

Although a detailed description of the present invention is provided above, it is to be understood that the scope of the invention is not to be limited thereby, but is to be determined by the claims which follow.

We claim:

1. A grip for holding a food product dispenser, comprising:

a finger loop;

a support ring surrounding said dispenser;

a rigid arm extending horizontally from said finger loop to said support ring;

a retaining finger, whereby said dispenser is retained within said support ring when dispensing food product; and a holding brace, which supports said dispenser in a upright position and prevents said dispenser from sliding out of said ring.

2. The grip of claim 1, wherein said finger loop is adjustable to accommodate a plurality of finger shapes and sizes.

3. The grip of claim 1, wherein said finger loop has an upper end and a lower end slidably disposed within a crimping band, such that said ends are slidably adjusted relative to each other to change the shape and size of said finger loop and said crimping band fixes said upper end and said lower end relative to each other.

4. The grip of claim 1, wherein said grip is made from a material selected from the group consisting of metal, wood, and plastic.

5. The grip of claim 1, wherein said dispenser has a bottom fill opening and said holding brace pivotally supports said dispenser, such that said dispenser is pivotable to permit access to said bottom fill opening.

6. The grip of claim 1, wherein said dispenser has a top fill opening and said holding brace pivotally supports said dispenser, such that said dispenser is pivotable to permit access to said top fill opening.

7. The grip of claim 1, wherein said retaining finger is flexible, such that said finger is displaced to remove said dispenser from said grip.

8. The grip of claim 1, wherein said holding brace supports said dispenser in a substantially upright position.

9. The grip of claim 1, wherein when said grip is placed on a flat surface, said holding brace supports said dispenser in a upright position and said finger loop is oriented vertically.

10. A grip for holding a seasoning shaker, comprising:

a finger loop;

a support ring surrounding said shaker;

a rigid arm extending horizontally from said finger loop to said support ring;

a retaining finger, whereby said shaker is retained within said support ring when dispensing seasoning, but wherein said retaining finger is flexible, such that said finger is displacable to remove said shaker from said grip; and a holding brace, which supports said shaker in a upright position and prevents said shaker from sliding out of said ring.

11. The grip of claim 10, wherein said finger loop is adjustable to accommodate a plurality of finger shapes and sizes.

12. The grip of claim 10, wherein said finger loop has an upper end and a lower end slidably disposed within a crimping band, such that said ends are slidably adjusted relative to each other to change the shape and size of said finger loop and said crimping band fixes said upper end and said lower end relative to each other.

13. The grip of claim 10, wherein said shaker has a bottom fill opening and said holding brace pivotally supports said shaker, such that said shaker is pivotable to permit access to said bottom fill opening.

* * * * *